United States Patent [19]

Shedlock

[11] 4,308,451

[45] Dec. 29, 1981

[54] OVERLAP DISTANCE INDICATING DEVICE

[76] Inventor: Culbert H. Shedlock, R.R. 2 Box 371K, Spring City, Tenn. 37381

[21] Appl. No.: 40,867

[22] Filed: May 21, 1979

[51] Int. Cl.[3] ..... G06C 27/00

[52] U.S. Cl. ..... 235/78 M; 235/88 M

[58] Field of Search ..... 235/70 R, 70 A, 78 N, 235/88 M, 78 M, 78 R, 88 R, 41, 116

[56] References Cited

U.S. PATENT DOCUMENTS

| | | | |
|---|---|---|---|
| Re. 28,033 | 6/1974 | Hannon | 235/70 A |
| 666,070 | 1/1901 | Schleicher | 235/88 M |
| 744,275 | 11/1903 | Anglund | 235/88 |
| 916,563 | 3/1909 | Kristopek | 235/88 M |
| 1,536,693 | 5/1925 | Schneider | 235/88 M |
| 2,163,032 | 6/1939 | Goldstein | 235/70 R |
| 3,199,777 | 8/1965 | Martens | 235/88 |
| 3,419,973 | 1/1969 | Manotas et al. | 235/88 M |
| 3,654,436 | 4/1972 | Sansom, Jr. | 235/78 N |

*Primary Examiner*—L. T. Hix
*Assistant Examiner*—Benjamin R. Fuller
*Attorney, Agent, or Firm*—Diller, Ramik & Wight

[57] ABSTRACT

A device for allowing a worker to lay out parallel lines which are to be spaced apart throughout by a constant distance S, and which lines include parallel but offset sections being joined by intervening angled sections with one of the lines of each offset section being extended to overlap the other by a distance D in order to maintain the lines parallel and spaced throughout by the distance S, the device including a first disc having indicia disposed on one side thereof which correspond to the slope and run of an angled section, and indicia disposed on the other side thereof which corresponds to the overlap distance D with the device further including two other discs, each of which is disposed over one of the surfaces of the first disc and including indicia corresponding to the rise of an angled section, thereby allowing a worker to align the indicia corresponding to the run or slope with that corresponding to the rise of an angled section, the device allowing a worker to obtain directly therefrom the requisite amount of overlap distance D for a specific spacing S from a measured value of either the slope or run of the angled sections.

27 Claims, 6 Drawing Figures

OVERLAP DISTANCE INDICATING DEVICE

BACKGROUND OF THE INVENTION

In the construction and carpentry fields it is often necessary or desirable to lay out parallel lines which are to be the routes for pipes, wiring, conduits, conduit trays, or the like. These routes or lines are to be spaced throughout by a constant distance in order to maintain the lines parallel. The lines or sections of parallel lines must, at times, be turned or otherwise angularly diverted from a straight path, thereby to define sections which are offset but parallel with respect to each other and which are interconnected by intervening angled sections. The lines of the angled sections are likewise parallel to each other and spaced apart by the same constant distance. This, of course, means that one line of each of the straight sections adjoining an angled section must be extended to overlap the other line by a specific distance in order for all of the lines to be maintained parallel and spaced apart throughout by a constant distance.

A major problem rises from such a manner of construction because it is often difficult for a worker to determine the amount of overlap required in order to maintain the spacing and parallelism between the lines of each section. The determination of this overlap, in the past, has required the use of a protractor and trigonometric calculations as the amount of overlap between the lines is a function in the angle between an angled section and an adjoining straight section. Such trigonometric calculations of the overlap distance is often beyond the normal range of skill of the construction worker.

A further problem arising from the determination of this overlap distance is that a typical worker, while being most adept with linear measurements, is not so adept with angular measurements. Therefore, it is imperative that a worker be able to derive the requisite amount of overlap distance from linear measurements.

SUMMARY OF THE INVENTION

The present invention pertains to a device for allowing a worker to determine the amount of overlap required to maintain lines of an angled section parallel and spaced throughout by a constant distance, from linear measurements of the slope or run of an angled section and the linear measurement of the rise of that angled section.

The device of the present invention generally comprises two fixed discs and a rotatable disc interposed between the two fixed discs. The rotatable disc has indicia disposed on one of the two surfaces thereof which correspond to linear measurements of the run and slope of an angled section, and disposed on the other surface thereof is indicia which corresponds to linear measurements of overlapped distances. One of the two fixed discs has window means disposed therein for exposing selected portions of the indicia corresponding to the slope and run of an angled section in correlation with indicia disposed adjacent thereto which corresponds to the rise of an angled section. The other one of the two fixed discs has further window means disposed therein for exposing selected portions of the indicia corresponding to the overlap distances, in correlation with indicia disposed adjacent thereto which corresponds to the spacing distances between the lines of each section.

In order to operate the device of the present invention, a worker merely has to rotate the rotatable disc while viewing the indicia thereon, corresponding to the measured run or slope of an angled section, through the window means of the one disc. When he has correlated the indicia corresponding to either the measured run or slope of an angled section with that corresponding to the measured rise of an angled section, disposed adjacent to the window means, he then can read directly from the window means of the other fixed disc the requisite amount of overlapped distance for a specific spacing between the lines of an angled section.

BRIEF DESCRIPTION OF THE DRAWING FIGURES

DETAILED DESCRIPTION

Figure 1:
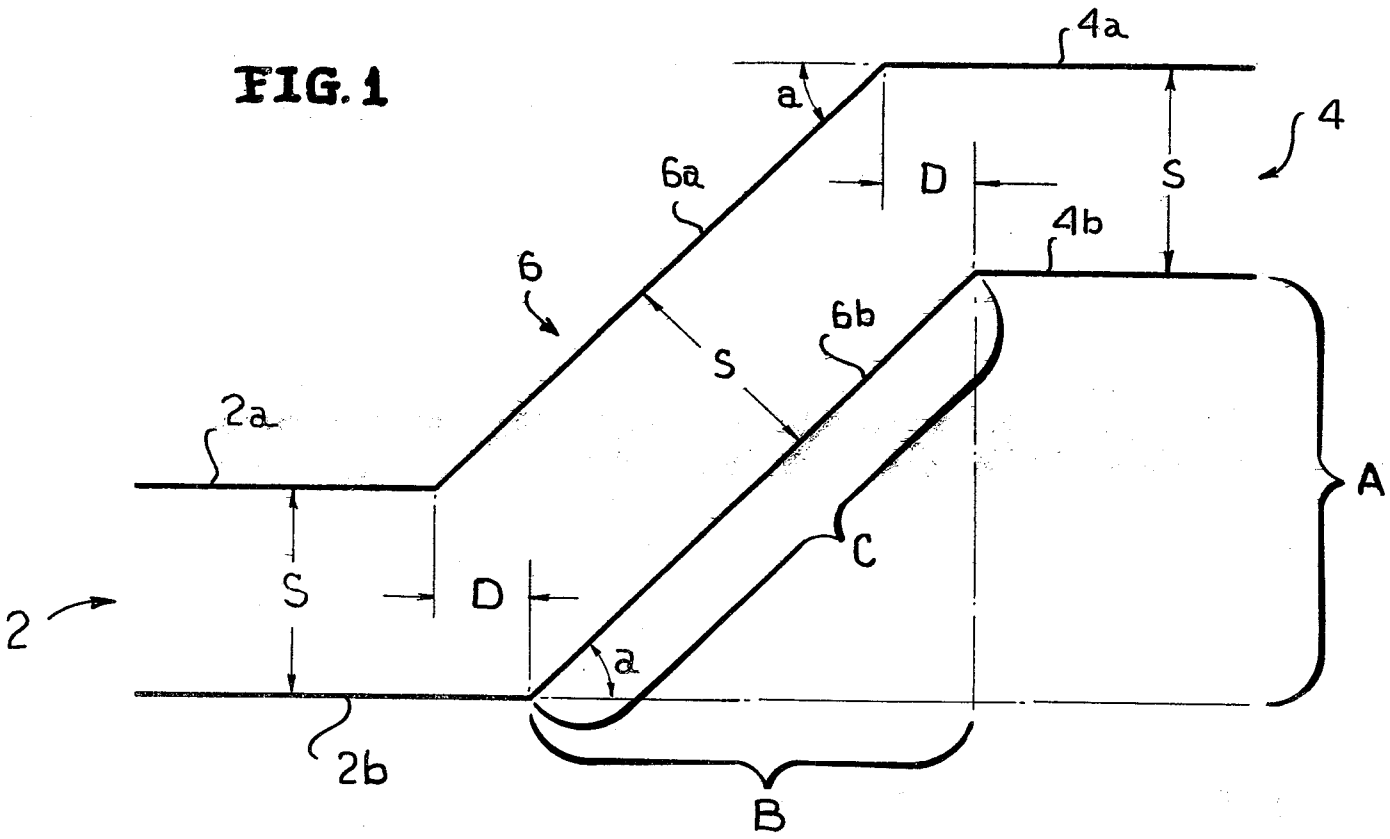
FIG. 1 is a diagrammatical representation of a pair of offset sections of parallel lines and an intervening angled section.

A diagrammatic illustration of parallel lines is shown in FIG. 1. The parallel lines delineate two offset parallel sections 2, 4 and an intervening angled section 6. The lines *2a*, *2b*, *4a*, *4b*, *6a* and *6b* of each of the sections 2, 4 and 6, respectively, are spaced apart throughout by a constant distance S. Due to an angle a of the angled section 6, one line *2b*, *4a* of each of the offset sections 2, 4 must be extended beyond the other *2a*, *4b* by a distance D in order to maintain the lines *2a*, *2b*, *4a*, *4b*, *6a* and *6b* of each section 2, 4 and 6, respectively, parallel and spaced apart throughout by the distance S.

The amount of overlap D is a function of the angle a and, therefore, varies proportionally with the angle a. More particularly, the overlapped distance D is equal to the tangent of one-half of the angle a.

However, a worker may not know the value of the angle a, and he must, therefore, determine the requisite amount of overlap D from the linear measurements of the slope C or the run B in relation to the measurement of the rise A of an angled section 6 and the spacing S between the lines of the sections 2, 4 and 6.

Figure 2:
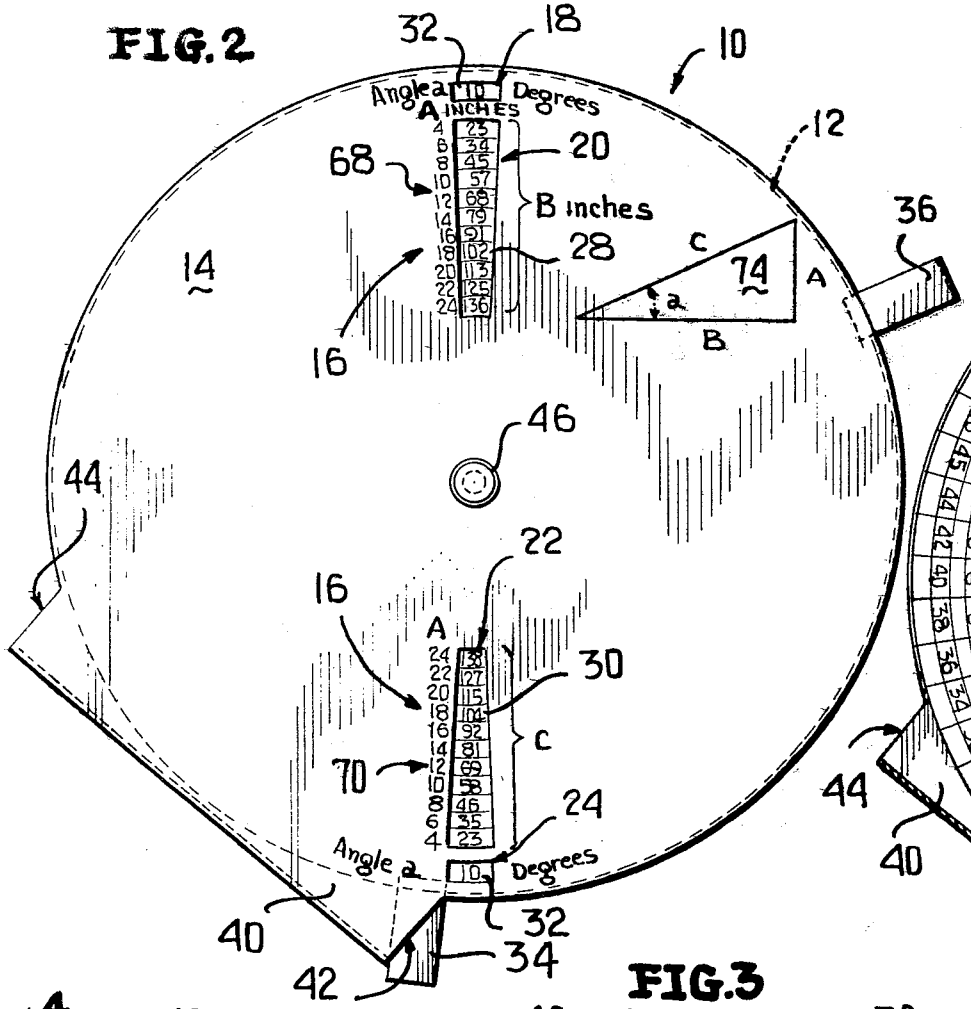
FIG. 2 is a plan view of the device of the invention, and illustrates a second disc and exposed portions of one surface of the first disc.

Referring to FIG. 2, the device or calculator 10 of the present invention includes a relatively rotatable disc or first disc means 12 disposed beneath a fixed second disc or disc means 14. The second disc 14 is provided with first window means 16 which consists of a plurality of openings 18, 20, 22 and 24. The window means 16 allows a worker to view selected portions of the first disc means 12 therethrough.

Figure 4:
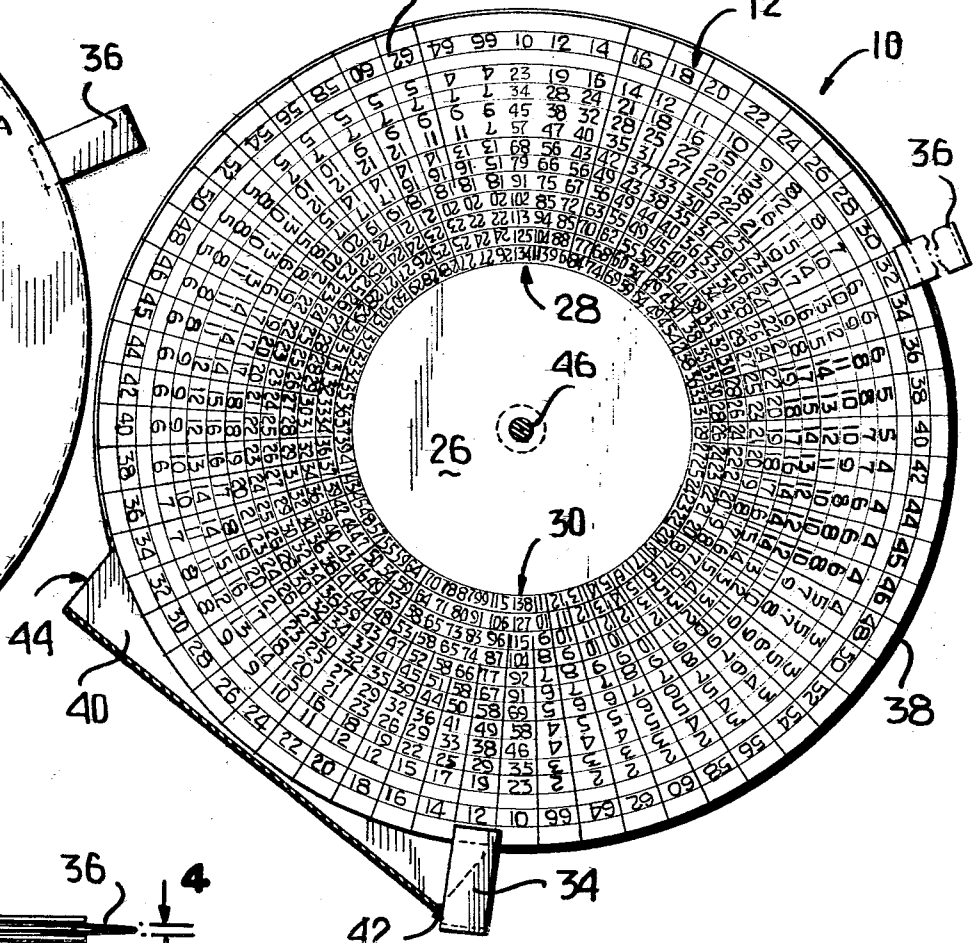
FIG. 4 is a plan view of one surface of the first disc of the device of the present invention.

As illustrated in FIG. 4, the first disc means 12 has disposed on one surface 26 thereof a plurality of radially extending columns of indicia, such as column 28, corresponding to linear measurements of the run B of an angled section 6, and a similar plurality of radially extending columns of indicia, such as column 30, corresponding to linear measurements of the slope C of an angled section 6. The columns of indicia 28 are disposed about the surface 26 in a clockwise direction from a twelve o'clock position to a six o'clock position and the column 30 extends from the six o'clock position to the twelve o'clock position. The surface 26 of the first disc means 12 further includes an outermost ring of indicia 32, disposed about a periphery thereof, which corresponds to measurements of the angle a of an angled section 6. The ring of indicia 32 consists of a portion of even angular measurements, from 10° to 66°, extending clockwise from a twelve o'clock position to a six o'clock position and a portion extending from the six o'clock position to the twelve o'clock position.

Referring again to FIG. 1, it will be appreciated that the indicia 32 corresponding to the angle a of an angled section 6 is exposed through the openings 18 and 24 of the window means 16 and the columns of indicia, such as column 28, are individually and selectively exposed through the opening 20 of the window means 16. Likewise, the columns of indicia corresponding to the slope C of an angled section, such as column 30, are selectively and individually exposed through the opening 22 of the window means 16.

Figure 3:
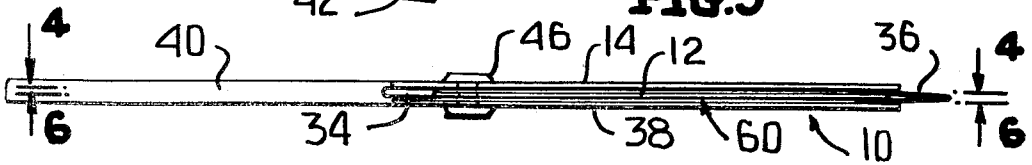
FIG. 3 is a side elevational view of the present invention.

The disc means 12 (FIG. 4) is provided with a pair of tabs or tab means 34, 36 which extend radially outwardly from a periphery thereof. These tab means 34, 36, allows a worker to manipulate the disc means 12 and rotate same relative to the second disc means 14 and a third fixed disc or disc means 38 of the device 10. The two fixed discs 14 and 38 are formed from a single sheet of material integrally interconnected by a bight portion 40 which maintains these two discs 14, 38 in their proper fixed, concentric relation. The bight portion 40 is adapted to be abutted at its edges 42, 44 by the tabs 34, 36, respectively, in order to limit the first disc means 12 to 180° of rotation. In this manner, it is assured that the indicia corresponding to the run B of an angled section 6 reflected by one of the columns 28 will be visible only through the opening 20 of the first window means 16, with which it is in underlying registry, and the indicia corresponding to the slope C of an angled section 6 reflected by one of the columns 30 will be visible only through the opening 22 of the first window means 16 with which it is in underlying registry (FIG. 2). Referring to FIG. 3, it will be noted that the first disc means 12 is disposed between the two fixed discs or the respective second and third disc means 14, 38 and is rotatably secured therebetween by an axle 46. The three discs 12, 14, 38 are, of course, maintained in concentric relation by the axle 46 and the discs 14, 38 are maintained relatively stationary by the bight portion 40.

Figure 6:
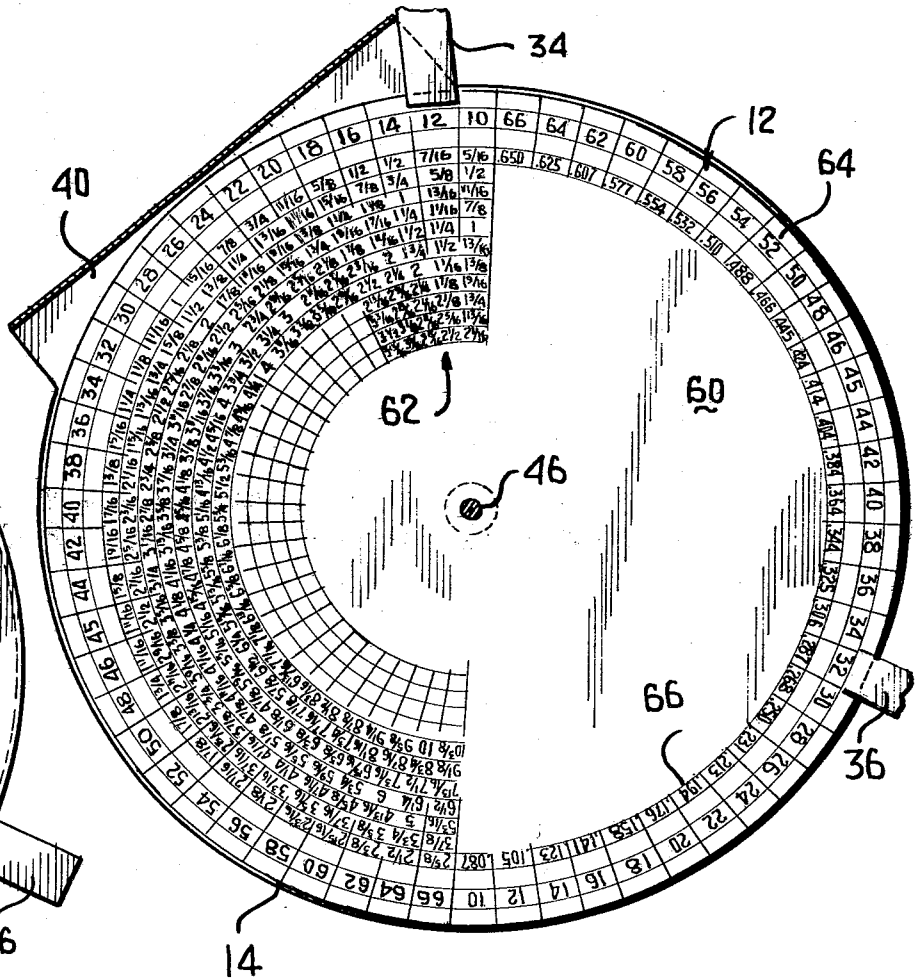
FIG. 6 is a plan view of another surface of the first disc of the device of the present invention.
Figure 5:
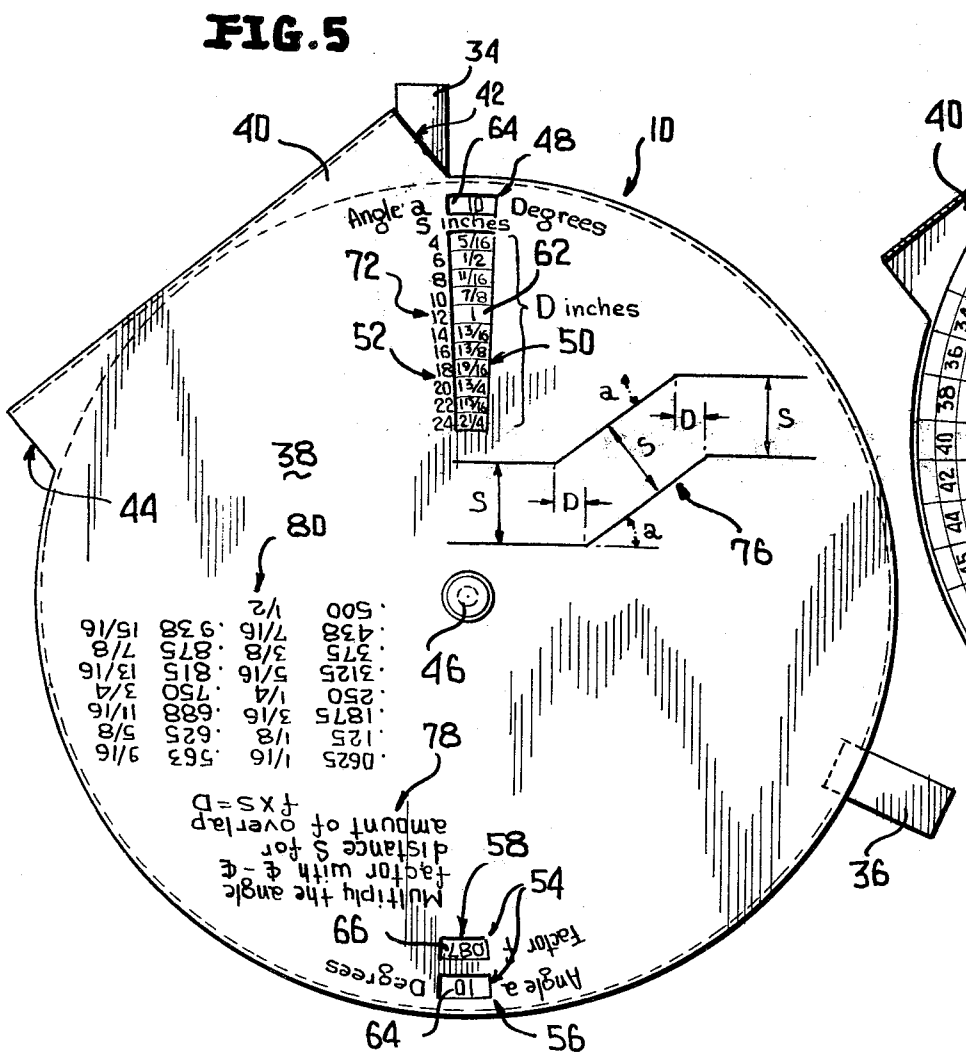
FIG. 5 is another plan view opposite to that shown in FIG. 1, and illustrates exposed portions of another surface of the first disc of the present invention.

The third disc or disc means 38 (FIG. 5) is provided with a plurality of openings 48, 50 defining a second window or window means 52. Third window means 54 are defined by openings 56 and 58. The window means 52, 54 are provided to allow a worker to view portions of another surface 60 (FIG. 6) of the first disc 12 therethrough. A plurality of radially extending columns of indicia, such as column 62, are disposed about roughly one-half of the surface 60 of the first disc 12. This indicia, which corresponds to linear measurements of overlapped distances D, is adapted to have individual columns thereof selectively viewed through the window means 50, as illustrated by the column 62 in FIG. 5. The surface 60 of the first disc 12 also has a ring of indicia 64, similar to the ring 32 of the surface 26, disposed about a periphery thereof corresponding to angular measurements of an angled section 6. This ring of indicia 64 is adapted to be viewed through both the opening 48 of the window means 52 and the opening 56 of the window means 54. Further, disposed about another half of the surface 60 of the first disc means 12 there is an arc of indicia 66 which corresponds to an angled factor f and is adapted to be viewed through the opening 58 of the window means 54. Again, due to the tab means 34, 36 which allows the first disc means 12 only 180° of rotation, the indicia corresponding to overlap distances D, as indicated by column 62, is visible only through the window means 52 and the arc of indicia 66 is visible only through the third window means 54.

As mentioned hereinbefore, the indicia of the arc of indicia 66 corresponds to an angled factor f which is a numeric approximation of the tangent of one-half of the angle a of an angled section. This angle factor f, when multiplied by the constant spacing distance S, yields the requisite amount of overlapped distance D for that spacing S for any angle a of an angled section 6 (FIG. 1).

Referring again to FIGS. 2 and 5, adjacent each opening 20 and 22 of the first window means 16 is a respective column of indicia 68, 70 which corresponds to linear measurements of the rise A of an angled section 6, and adjacent to the opening 50 of the second window means 52, there is disposed a column of indicia 72 which corresponds to linear measurements of the spacing distance S between the lines of each section 2, 4 and 6. Each of these columns of indicia 68, 70, 72 consists of a scale of the even integers 4 through 24, inclusive, and each is adapted to have a respective column of indicia 28, 30 and 62 brought into registry therewith through their respective window means 16, 52.

OPERATION OF THE INVENTION

In order to operate the calculator 10, of the present invention, a worker must know the spacing or constant distance S between the lines of each section 2, 4 and 6 and the linear measurement of the rise A of the angled section 6 with which he is concerned (FIG. 1). Further the worker must also know the linear measurement of either the slope C or the run B of the particular angled section 6. Assuming, for example, that the measured value of the rise A is equal to 12 inches and that the measured value of the run B is equal to 68 inches, the worker merely needs to rotate or dial the first disc means 12 (FIG. 2) until the measured value for the run B appears through the opening 20 of the first window means in correlation with the measured value of the rise A of 12 inches appearing in the column of indicia 68 disposed adjacent to the opening 20. The worker will then note that appearing through the opening 22 of the first window means 16, in correlation with the integer 12 of the column of indicia 70, is the integer 69 which corresponds to the measured value of the slope C of an angled section 6, and also appearing through the openings 18 and 24 of the first window means 16 are the integers 10, of the ring of indicia 32, which correspond to the angle a of the angled section 6. Therefore, a worker need only know the value of the slope C in relation to that of the rise A or the value of the run B in relation to that of the rise A, or the value of the angle a of the angled section 6 (FIG. 1) as the input to be entered into the calculator 10. The worker then enters that input into the calculator 10 by registering the indicia corresponding to the known information with its associated opening of the first window means 16. The worker then flips the calculator 10 over (FIG. 5) so that he can view through the second window means 52 of the third disc means 38 the requisite amount of overlap D between the lines of the sections 2, 4 adjoining an angled section 6 having the specific spacing S. Assuming, again for example, that the constant spacing distance S is equal to 12 inches, the worker will note that the integer 1 appears through the opening 50 of the second window means 52 in registry with the integer 12 of the column of indicia 72. This then informs the worker that the proper amount of overlap D between the lines of the straight sections 2, 4 adjoining the angled section 6 (FIG. 1) is equal to one inch. In this manner, the worker can determine directly from a single setting of the calculator 10 the requisite amount of overlap D for any one of the inputs, mentioned hereinbefore, entered therein. The worker will also note that appearing through the opening 48 of the second window means 52 is a portion of the ring of indicia 64 which again corresponds to the angle a of the angled section 6. Further, he will note that a portion of the arc of indicia 66 corresponding to the afore-mentioned angled factor f is in registry with the opening 58 of the third window means 54. Therefore, if the measured value of the spacing S, or the measured value of the rise A exceeds the limits of the scales 68 or 70, he can determine the overlap distance D directly from the product of the measured distance S and the angled factor f for a measured angle a. In this manner, the worker can determine the overlap distance D for the lines *2b*, *4a* section 2, 4 even if the inputs for the angled section 6 exceed the normal range of values corresponding to the run, rise and slope B, A, and C displayed on the second disc means 14 or the value S displayed on the third disc means 38.

Therefore, as described hereinbefore, a worker, using the device 10 of the present invention, can accurately lay out routes for pipes or the like so that upon installation of same he merely has to dimension the pipes or the like to conform to the dimensions of the lines *2a*, *2b*, *4a*, *4b*, *6a* and *6b* of the sections 2, 4 and 6 previously layed out.

From FIG. 2 it will be noted that the second disc means 14 has a diagrammatical representation of a triangle 74 disposed thereon. The slope of the triangle is labeled with the character C which corresponds to the slope of an angled section, and the other sides are labeled with the character B and A which correspond to the run and rise, respectively, of an angled section. Further, from FIG. 5, it will be noted that the third disc means 38 is provided with a diagrammatical representation of two straight sections and an intervening angled section 76. The third disc means 38 also includes instructions in the use of the angle factor f 78, and a decimal/fraction conversion chart 80. The diagrams 74,76 are included on the calculator 10 in order to inform a worker as to where the measurements for run B, rise A, slope C and spacing S are to be taken, and the chart 80 and instructions 78 are provided to assist the worker in the use of the angle factor f.

It should be clearly understood that the description and illustrations herein are of the preferred embodiment of the present invention and that same are not intended to limit the scope or spirit of this invention any further than is required by the appending claims.

I claim:

1. A device for allowing a worker to lay out parallel lines which are to be disposed apart throughout by a constant distance S, and which lines include parallel but offset sections joined by intervening angled sections with one of the lines of each of said offset sections being extended to overlap the other by a distance D in order to maintain said lines parallel and spaced throughout by said distance S, said device comprising in combination:

first disc means having indicia disposed thereon in radially extending columns for indicating selective columns of said indicia corresponding to measurements of the run or slope of said angled sections;

second disc means for covering said first disc means in concentric relation therewith and being relatively rotatable thereto, said second disc means having window means disposed thereon for exposing individual columns of said indicia, said window means having indicia disposed adjacent thereto which corresponds to measurements of the rise of said angled sections; and means for allowing a worker to read directly from a single setting of said device, the requisite amount of overlap D for a selected spacing S when the corresponding value of the measured run or slope of said columns of indicia is in alignment with the corresponding value of the measured rise of said angled sections indicated adjacent to said window means.

2. The device as defined in claim 1 wherein said first disc means includes a first ring of indicia disposed about the periphery thereof, said first ring of indicia corresponding to angular measurements of said angled sections, and said second disc means includes further window means for exposing a selected portion of said ring of indicia thereby to allow a worker to determine said overlap distance D from a measurement of the angle of said angled sections.

3. The device as defined in claim 2 wherein said first disc means includes a second ring of indicia disposed about the periphery thereof, said second ring being concentric with and spaced radially inwardly from said first ring of indicia, said second ring of indicia corresponding to an angle factor, and further means for exposing a selected portion of said second ring when the measured angle of said angled sections is in alignment with its associated window means, said angle factor allowing a worker to multiply same by said distance S to yield said overlap distance D.

4. A device for allowing a worker to lay out parallel lines which are to be disposed apart throughout by a constant distance S, and which lines include parallel but offset sections joined by intervening angled sections with one of the lines of each of said offset sections being extended to overlap the other by a distance D in order to maintain said lines parallel and spaced throughout by said distances S, said device comprising in combination:

first disc means having indicia disposed on one surface thereof in radially extending columns with selective columns of said indicia corresponding to measurements of the run and slope of said angled sections, and indicia disposed on another surface thereof in radially extending columns corresponding to measurements of said overlap distance D;

second disc means disposed over said one surface of said first disc means in concentric relation therewith and being relatively rotatable thereto, said second disc means having first window means disposed thereon for exposing individual columns of said indicia of said one surface, said first window means having indicia disposed adjacent thereto which corresponds to measurements of the rise of said angled sections; and third disc means disposed over said another surface of said first disc means in concentric relation therewith and being relatively rotatable thereto, said third disc means having second window means disposed thereon for exposing individual columns of said indicia of said other surface, said second window means having indicia disposed adjacent thereto which corresponds to measurements of said constant distance S, thereby to allow a worker to read directly from said second window means, from a single setting of said device, the requisite amount of overlap D for a specific spacing S when the corresponding value of the measured run or slope of said columns of indicia is in alignment with the corresponding value of the measured rise of said angled sections indicated adjacent to said first window means.

5. The device as defined in claim 4 wherein said first disc means is rotatable about 180° of rotation and said first and second window means include openings disposed respectively on said second and third disc means with the openings of each of said second and third disc means being at least in part angularly spaced 180° apart from each other.

6. The device as defined in claim 4 wherein said first disc means includes tab means extending radially outwardly from a periphery thereof for manipulation by a worker to rotate said first disc means.

7. The device as defined in claim 6 including stop means for abutment by said tab means thereby to limit said first disc means to said 180° of rotation.

8. The device as defined in claim 7 wherein said stop means is defined by a bight portion integrally interconnecting said second and third disc means.

9. The device as defined in claim 4 wherein said first disc means is rotatably secured between said second and third disc means by an axle passing through the center of the three disc means.

10. The device as defined in claim 4 wherein said first disc means includes a first ring of indicia disposed about a periphery of said one surface thereof, and a second ring of indicia disposed about a periphery of said another surface thereof, said first ring and said second ring of indicia corresponding to angular measurements of said angled sections and being viewed through said first and second window means, respectively.

11. The device as defined in claim 10 wherein said first disc means includes a third ring of indicia disposed about a periphery of said another surface thereof in concentric relation to and spaced radially inwardly from said second ring of indicia, said indicia of said third ring corresponding to an angle factor which when multiplied by said distance S yields said overlap D, and said indicia having portions thereof exposed through said second window means.

12. The device as defined in claim 11 wherein said indicia disposed adjacent to each of said window means indicate the even integers between 4 and 24 inclusive, and thereby said angle factor is operative to determine the overlap distance D for spacing distances S not indicated by said even integers.

13. The device as defined in claim 11 wherein said indicia corresponding to said angle factor is in decimal notation and said second disc means includes a decimal/fraction conversion chart.

14. The device as defined in claim 4 wherein said third disc means includes a diagrammatical representation of a pair of offset sections and an intervening angled section with the distances S and D and the angular measurements of said angled section being located thereon.

15. The device as defined in claim 12 wherein said second disc means includes a diagrammatical representation of a triangle, the slope of which represents one line of an angled section and the two remaining sides represent the run and rise of the angled section.

16. The device as defined in claim 13 wherein said third disc means includes the formula $f \times S = D$ wherein f represents the angle factor, S the spacing distance and D the overlap distance, thereby to instruct a worker in the use of said angle factor.

17. The device as defined in claim 14 wherein adjacent to said first window means there is disposed further indicia labelling said first and second plurality of columns as the measurements of the run and slope, and adjacent to said second window means there is disposed further indicia labelling said third plurality of columns as the measurements of the distance D.

18. A device for allowing a worker to lay out parallel lines which are to be disposed apart throughout by a selected constant distance S, and which lines include parallel but offset sections joined by intervening angled sections with one of the lines of each of said offset sections being extended to overlap the other by a distance D in order to maintain said lines parallel and spaced throughout by said distance S, said device comprising in combination:

a first plurality of indicia means for indicating measurements corresponding to at least two of the run or the rise, slope and angle of said angled sections;

a second plurality of indicia means for indicating measurements corresponding to a plurality of different distances S;

means for effecting movement between a first of said at least two measurements of said first plurality of indicia means relative to a second of said at least two measurements of said first plurality of indicia means; and means responsive to the movement of said last-mentioned means for indicating the requisite amount of overlap D for a selected one of said plurality of different distances S.

19. A device for allowing a worker to lay out parallel lines which are to be disposed apart throughout by a constant distance S, and which lines include parallel but offset sections each including a run B and slope C and being joined by intervening angled sections defined by angles a, with one of the lines of each of said offset sections being extended to overlap the other by a distance D in order to maintain said lines parallel and spaced throughout by said distance S, said device comprising in combination first, second and third discs, means for rotatably mounting said first disc between and relative to said second and third discs, said first disc having opposite first and second surfaces, said first surface having thereon a first plurality of radially extending columns of first indicia means for corresponding to linear measurements of the runs of angled sections, said first surface having thereon a second plurality of radially extending columns of second indicia means for corresponding to linear measurements of the slopes of angled sections, said first and second indicia means being disposed on opposite semicircular surface portions of said first surface, an outermost ring of third indicia means on said first surface for corresponding to angular measurements of the angle defined by the runs and slopes, first and second window means in said second disc for exposing said first and third indicia means therethrough, respectively, and third and fourth window means in said second disc for exposing said second and third indicia means therethrough, respectively, fourth and fifth indicia means for corresponding to the rises of angled sections disposed adjacent said first and third window means, said second surface have upon a semicircular surface portion thereof sixth indicia means in the form of a plurality of radially extending columns of indicia for corresponding to linear measurements of overlapped distances of the offset sections, first and second concentric rings of seventh and eighth indicia means on said second surface for corresponding to angular measurements of angled sections and for corresponding to an angled factor of angled sections, respectively, said third disc having fifth, sixth and seventh window means for exposing said sixth indicia means, said seventh indicia means and said eighth indicia means, respectively, and ninth indicia means for corresponding to overlap distances of the angled sections disposed adjacent said fifth window means whereby knowing a distance S, rise A and the slope C or run B of a particular angled section or the slope C relative to the rise A or the run B relative to the rise A or the angle a of a particular angled section the requisite amount of overlap D can be determined.

20. The device as defined in claim 1 wherein said indicia on said first disc means is disposed in two sets of columns with one set corresponding to measurements of run being disposed on one semicircular portion of a first surface of said first disc means and with another set corresponding to measurements of slope being disposed on another semicircular portion of said first surface, and said window means being a pair of windows disposed generally diametrically opposite from each other through which the run and slope indicia can be respectively exposed.

21. The device as defined in claim 20 including means for preventing said first disc means from rotating beyond 360 degrees.

22. The device as defined in claim 2 wherein said indicia on said first disc means is disposed in two sets of columns with one set corresponding to measurements of run being disposed on one semicircular portion of a first surface of said first disc means and with another set corresponding to measurements of slope being disposed on another semicircular portion of said first surface, and said window means being a pair of windows disposed generally diametrically opposite from each other through which the run and slope indicia can be respectively exposed.

23. The device as defined in claim 3 wherein said indicia on said first disc means is disposed in two sets of columns with one set corresponding to measurements of run being disposed on one semicircular portion of a first surface of said first disc means and with another set corresponding to measurements of slope being disposed on another semicircular portion of said first surface, and said window means being a pair of windows disposed generally diametrically opposite from each other through which the run and slope indicia can be respectively exposed.

24. The device as defined in claim 22 including means for preventing said first disc means from rotating beyond 360 degrees.

25. The device as defined in claim 23 including means for preventing said first disc means from rotating beyond 360 degrees.

26. The device as defined in claim 4 wherein said indicia on said one surface of said first disc means is disposed in two sets of columns with one set corresponding to measurements of run being disposed on one semicircular portion of said one surface and with another set corresponding to measurements of slope being disposed on another semicircular portion of said one surface, and said first window means being a pair of windows disposed generally diametrically opposite from each other through which the run and slope indicia can be respectively exposed.

27. The device as defined in claim 26 including means for preventing said first disc means from rotating beyond 360 degrees.

* * * * *